US008511053B2

(12) United States Patent
Chou et al.

(10) Patent No.: US 8,511,053 B2
(45) **Date of Patent: *Aug. 20, 2013**

(54) SYNTHETIC ROPE FORMED OF BLEND FIBERS

(75) Inventors: Chia-Te Chou, Bellingham, WA (US); Danielle Dawn Stenvers, Ferndale, WA (US); Howard Philbrook Wright, Jr., Ferndale, WA (US); Liangfeng Sun, Bellingham, WA (US)

(73) Assignee: Samson Rope Technologies, Ferndale, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/367,215

(22) Filed: Feb. 6, 2012

(65) Prior Publication Data

US 2012/0131895 A1 May 31, 2012

Related U.S. Application Data

(63) Continuation of application No. 12/463,284, filed on May 8, 2009, now Pat. No. 8,109,072.

(60) Provisional application No. 61/130,986, filed on Jun. 4, 2008.

(51) Int. Cl.
*D02G 3/02* (2006.01)

(52) U.S. Cl.
USPC ..... 57/237; 57/238

(58) Field of Classification Search
USPC ..... 57/210, 230, 236, 237, 238, 244
See application file for complete search history.

(56) References Cited

U.S. PATENT DOCUMENTS

| | | | |
|---|---|---|---|
| 1,490,387 | A | 4/1924 | Hansen |
| 1,695,480 | A | 10/1926 | Buoy |
| 1,710,740 | A | 4/1929 | Ljungkull |
| 1,850,767 | A | 12/1930 | Page |
| 1,833,587 | A | 1/1931 | Page |

(Continued)

FOREIGN PATENT DOCUMENTS

| | | |
|---|---|---|
| CA | 2019499 | 2/2000 |
| CN | 200910203184.0 | 6/2009 |

(Continued)

OTHER PUBLICATIONS

TENCOM Ltd., http://www.tencom.com/02/pultrusion.htm, "Pultrusion Process", 2006, 2 pages.

(Continued)

*Primary Examiner* — Shaun R Hurley
(74) *Attorney, Agent, or Firm* — Michael R. Schacht; Schacht Law Office, Inc.

(57) ABSTRACT

A rope structure comprising a plurality of rope subcomponents, a plurality of bundles, a plurality of first yarns, and a plurality of second yarns. The rope subcomponents are combined to form the rope structure. The bundles are combined to form the rope subcomponents. The first yarns are formed of at least one material selected from the group of materials comprising HMPE, LCP, Aramids, and PBO and have a breaking elongation of approximately 2%-5%. The plurality of second yarns are formed of at least one material selected from the group of materials comprising polyolefin, polyethylene, polypropylene, and blends or copolymers of the two and have a breaking elongation of approximately 2%-12%. The first and second yarns are combined to form the bundles.

19 Claims, 3 Drawing Sheets

(56) References Cited

U.S. PATENT DOCUMENTS 1,908,686 A 5/1933 Burke
1,931,808 A 10/1933 Andersen
2,245,824 A 6/1941 Roesch
2,299,568 A 10/1942 Dickey
2,338,831 A 1/1944 Whitcomb et al.
2,359,424 A 10/1944 Joy
2,960,365 A 11/1960 Meisen
3,035,476 A 5/1962 Fogden
3,073,209 A 1/1963 Benk et al.
3,276,810 A 10/1966 Antell
3,367,095 A 2/1968 Field, Jr.
3,371,476 A 3/1968 Costello et al.
3,383,849 A 5/1968 Stirling
3,411,400 A 11/1968 Morieras et al.
3,415,052 A 12/1968 Stanton
3,425,737 A 2/1969 Sutton
RE26,704 E 11/1969 Norton
3,481,134 A 12/1969 Whewell, Jr.
3,507,949 A 4/1970 Campbell
3,537,742 A 11/1970 Black
3,561,318 A 2/1971 Andriot, Jr.
3,653,295 A 4/1972 Pintard
3,662,533 A 5/1972 Snellman et al.
3,718,945 A 3/1973 Brindejonc de Treglode
3,729,920 A 5/1973 Sayers et al.
3,762,865 A 10/1973 Weil
3,771,305 A 11/1973 Barnett
3,839,207 A 10/1974 Weil
3,854,767 A 12/1974 Burnett
3,904,458 A 9/1975 Wray
3,906,136 A 9/1975 Weil
3,915,618 A 10/1975 Feucht et al.
3,943,644 A 3/1976 Walz
3,957,923 A 5/1976 Burke
3,977,172 A 8/1976 Kerawalla
3,979,545 A 9/1976 Braus et al.
4,031,121 A 6/1977 Brown
4,036,101 A 7/1977 Burnett
4,050,230 A 9/1977 Senoo et al.
4,099,750 A 7/1978 McGrew
4,116,481 A 9/1978 Raue
4,155,394 A 5/1979 Shepherd et al.
4,159,618 A 7/1979 Sokaris
4,170,921 A 10/1979 Repass
4,173,113 A 11/1979 Snellman et al.
4,184,784 A 1/1980 Killian
4,195,113 A 3/1980 Brook
4,202,164 A 5/1980 Simpson et al.
4,210,089 A 7/1980 Lindahl
4,226,035 A 10/1980 Saito
4,228,641 A 10/1980 O'Neil
4,232,903 A 11/1980 Welling et al.
4,250,702 A 2/1981 Gundlach
4,257,221 A 3/1981 Feinberg
4,286,429 A 9/1981 Lin
4,312,260 A 1/1982 Morieras
4,321,854 A 3/1982 Foote et al.
4,329,794 A 5/1982 Rogers
4,350,380 A 9/1982 Williams
4,403,884 A 9/1983 Barnes
4,412,474 A 11/1983 Hara
4,421,352 A 12/1983 Raue et al.
4,464,812 A 8/1984 Crook, Jr. et al.
4,500,593 A 2/1985 Weber
4,509,233 A 4/1985 Shaw
4,534,163 A 8/1985 Schuerch
4,534,262 A 8/1985 Swenson
4,563,869 A 1/1986 Stanton
4,606,183 A 8/1986 Riggs
4,619,108 A 10/1986 Hotta
4,635,989 A 1/1987 Tremblay et al.
4,640,179 A 2/1987 Cameron
4,642,854 A 2/1987 Kelly et al.
4,677,818 A 7/1987 Honda et al.
4,757,719 A 7/1988 Franke
4,762,583 A 8/1988 Kaempen
4,779,411 A 10/1988 Kendall
4,784,918 A 11/1988 Klett et al.
4,850,629 A 7/1989 St. Germain
4,856,837 A 8/1989 Hammersla, Jr.
4,868,041 A 9/1989 Yamagishi et al.
4,887,422 A 12/1989 Klees et al.
4,947,917 A 8/1990 Noma et al.
4,958,485 A 9/1990 Montgomery et al.
4,974,488 A 12/1990 Spralja
5,060,466 A 10/1991 Matsuda et al.
5,091,243 A 2/1992 Tolbert et al.
5,141,542 A 8/1992 Fangeat et al.
5,178,923 A 1/1993 Andrieu et al.
5,211,500 A 5/1993 Takaki et al.
5,240,769 A 8/1993 Ueda et al.
5,288,552 A 2/1994 Hollenbaugh, Jr. et al.
5,296,292 A 3/1994 Butters
5,327,714 A 7/1994 Stevens et al.
5,333,442 A 8/1994 Berger
5,378,522 A 1/1995 Lagomarsino
5,429,869 A 7/1995 McGregor et al.
5,441,790 A 8/1995 Ratigan
5,497,608 A 3/1996 Matsumoto et al.
5,501,879 A 3/1996 Murayama
5,506,043 A 4/1996 Lilani
5,525,003 A 6/1996 Williams et al.
5,643,516 A 7/1997 Raza et al.
5,651,572 A 7/1997 St. Germain
5,669,214 A 9/1997 Kopanakis
5,699,657 A 12/1997 Paulson
5,711,243 A 1/1998 Dunham
5,718,532 A 2/1998 Mower
5,727,833 A 3/1998 Coe
5,802,839 A 9/1998 Van Hook
5,822,791 A 10/1998 Baris
5,826,421 A 10/1998 Wilcox et al.
5,852,926 A 12/1998 Breedlove
5,873,758 A 2/1999 Mullins
5,904,438 A 5/1999 Vaseghi et al.
5,931,076 A 8/1999 Ryan
5,943,963 A 8/1999 Beals
5,978,638 A 11/1999 Tanaka et al.
6,015,618 A 1/2000 Orima
6,033,213 A 3/2000 Halvorsen, Jr.
6,045,571 A 4/2000 Hill et al.
6,085,628 A 7/2000 Street et al.
6,122,847 A 9/2000 Treu et al.
6,146,759 A 11/2000 Land
6,164,053 A 12/2000 O'Donnell et al.
6,265,039 B1 7/2001 Drinkwater et al.
6,295,799 B1 10/2001 Baranda
6,341,550 B1 * 1/2002 White ..... 87/5
6,365,070 B1 4/2002 Stowell et al.
6,405,519 B1 6/2002 Shaikh et al.
6,410,140 B1 6/2002 Land et al.
6,422,118 B1 7/2002 Edwards
6,484,423 B1 11/2002 Murray
6,524,690 B1 2/2003 Dyksterhouse
6,592,987 B1 7/2003 Sakamoto et al.
6,601,378 B1 8/2003 Fritsch et al.
6,704,535 B2 3/2004 Kobayashi et al.
6,876,798 B2 4/2005 Triplett et al.
6,881,793 B2 4/2005 Sheldon et al.
6,916,533 B2 7/2005 Simmelink et al.
6,945,153 B2 * 9/2005 Knudsen et al. ..... 87/1
7,051,664 B2 5/2006 Robichaud et al.
7,093,416 B2 8/2006 Johnson et al.
7,127,878 B1 10/2006 Wilke et al.
7,134,267 B1 11/2006 Gilmore et al.
7,137,617 B2 11/2006 Sjostedt
7,165,485 B2 1/2007 Smeets et al.
7,168,231 B1 * 1/2007 Chou et al. ..... 57/210
7,172,878 B1 2/2007 Nowak et al.
7,182,900 B2 2/2007 Schwamborn et al.
7,296,394 B2 11/2007 Clough et al.
7,331,269 B2 2/2008 He et al.
7,367,176 B1 * 5/2008 Gilmore et al. ..... 57/237
7,389,973 B1 6/2008 Chou et al.

| | | | | |
|---|---|---|---|---|
| 7,415,783 | B2 | 8/2008 | Huffman et al. | |
| 7,437,869 | B1 | 10/2008 | Chou et al. | |
| 7,472,502 | B2 | 1/2009 | Gregory et al. | |
| 7,475,926 | B2 | 1/2009 | Summars | |
| 7,568,419 | B2 | 8/2009 | Bosman | |
| 7,637,549 | B2 | 12/2009 | Hess | |
| 7,681,934 | B2 | 3/2010 | Harada et al. | |
| 7,735,308 | B1 | 6/2010 | Gilmore et al. | |
| 7,739,863 | B1 | 6/2010 | Chou et al. | |
| 7,743,596 | B1 | 6/2010 | Chou et al. | |
| 7,784,258 | B2 | 8/2010 | Hess | |
| 7,823,496 | B2 | 11/2010 | Bosman et al. | |
| 7,849,666 | B2 | 12/2010 | Kirth et al. | |
| 7,908,955 | B1 | 3/2011 | Chou et al. | |
| 8,109,071 | B2 | 2/2012 | Gilmore | |
| 8,109,072 | B2 | 2/2012 | Chou et al. | |
| 8,171,713 | B2 | 5/2012 | Gilmore et al. | |
| 8,171,714 | B2 | 5/2012 | Wienke et al. | |
| 8,302,374 | B2 | 11/2012 | Marissen et al. | |
| 8,341,930 | B1 | 1/2013 | Chou et al. | |
| 8,387,505 | B2 | 3/2013 | Chou et al. | |
| 2003/0200740 | A1 | 10/2003 | Tao et al. | |
| 2003/0226347 | A1 | 12/2003 | Smith et al. | |
| 2004/0025486 | A1 | 2/2004 | Takiue | |
| 2005/0172605 | A1 | 8/2005 | Vancompernolle et al. | |
| 2006/0048494 | A1 | 3/2006 | Wetzels et al. | |
| 2006/0048497 | A1 | 3/2006 | Bloch | |
| 2006/0179619 | A1 | 8/2006 | Pearce et al. | |
| 2006/0213175 | A1 | 9/2006 | Smith et al. | |
| 2007/0079695 | A1 * | 4/2007 | Bucher et al. | 87/8 |
| 2007/0137163 | A1 | 6/2007 | Hess | |
| 2007/0144134 | A1 | 6/2007 | Kajihara | |
| 2007/0169457 | A1 | 7/2007 | Kijesky | |
| 2007/0266693 | A1 | 11/2007 | Kato et al. | |
| 2009/0047475 | A1 | 2/2009 | Jeon | |
| 2011/0083415 | A1 | 4/2011 | Marissen et al. | |

FOREIGN PATENT DOCUMENTS

| | | |
|---|---|---|
| EP | 2130969 | 12/2009 |
| JP | 1260080 | 10/1989 |
| JP | 2242987 | 9/1990 |
| JP | 3033285 | 2/1991 |
| JP | 2000212884 | 8/2000 |
| JP | 2004126505 | 4/2001 |
| JP | 2009293181 | 12/2009 |
| KR | 1019900010144 | 7/1990 |
| KR | 1020090044381 | 5/2009 |
| RU | 2295144 | 10/2007 |
| WO | 03102295 | 12/2003 |
| WO | 2008144046 | 11/2008 |
| WO | 2008144047 | 11/2008 |
| WO | 2008144048 | 11/2008 |

OTHER PUBLICATIONS

US District Court, *Samson Rope Technologies, Inc.* v. *Yale Cordage, Inc.* Case 2:11-cv-00328, Document 1, Complaint (2), DI 001-2011-02-24, 5 pages.

US District Court, *Samson Rope Technologies, Inc.* v. *Yale Cordage, Inc.* Case 2:11-cv-00328-JLR, Document 5, Notice to PTO, DI 005-2011-02-25, 1 page.

US District Court, *Samson Rope Technologies, Inc.* v. *Yale Cordage, Inc.* Case 2:11-cv-00328-JLR, Document 12, Answer, DI 012-2011-05-10, 6 pages.

Samson Rope Technologies, Inc., "M-8 Offshore Rope", Mar. 2008, 1 page.

ENTEC, http://www.entec.com/pultrusion.shtml, "Pultrusion Equipment", Nov. 2006, 4 pages.

International Searching Authority, "ISR PCT/US2008/006421", Sep. 30, 2008, 12 pages.

International Searching Authority, "ISR PCT/US2008006422", Oct. 27, 2008, 10 pages.

International Searching Authority, "ISR PCT/US2008006423", Jul. 29, 2008, 10 pages.

International Searching Authority, "ISR PCT/US2011/055212", Oct. 25, 2012, 10 pages.

International Searching Authority, "ISR PCT/US2012039460", Sep. 13, 2012, 7 pages.

Pultrusion Industry Council, http://www.acmanet.org/pic/products/description.htm, "products & process: process description", 2001, 2 pages.

Samson Rope Technologies, Inc., "Innovative Chafe Protection Solutions for High Performance Ropes", 2006, 4 pages.

Samson Rope Technologies, Inc., "Dynalene Installation Instructions for Covering 12-Strand Rope", 2005, 12 pages.

Samson Rope Technologies, Inc., "Samson Deep Six Performs Beyond Expectation", 2008, 2 pages.

Samson Rope Technologies, Inc., "Samson Offshore Expansion Celebrated", 2009, 2 pages.

* cited by examiner

SYNTHETIC ROPE FORMED OF BLEND FIBERS

RELATED APPLICATIONS

This application, U.S. patent application Ser. No. 13/367,215 filed Feb. 6, 2012, is a continuation of U.S. patent application Ser. No. 12/463,284 filed May 8, 2009, now U.S. Pat. No. 8,109,072, which issued on Feb. 7, 2012.

U.S. patent application Ser. No. 12/463,284 claims benefit of U.S. Provisional Patent Application Ser. No. 61/130,986 filed Jun. 4, 2008.

The contents of all related applications identified above are incorporated herein by reference.

TECHNICAL FIELD

The present invention relates to rope structures, systems, and methods and, more particularly, to combinations of fibers to obtain rope structures, systems, and methods providing improved performance.

BACKGROUND

The basic element of a typical rope structure is a fiber. The fibers are typically combined into a rope subcomponent referred to as a yarn. The yarns may further be combined to form rope subcomponents such as bundles or strands. The rope subcomponents are then combined using techniques such as braiding, twisting, and weaving to form the rope structure.

Different types of fibers typically exhibit different characteristics such as tensile strength, density, flexibility, and abrasion resistance. Additionally, for a variety of reasons, the costs of different types of fibers can vary significantly.

A rope structure designed for a particular application may comprise different types of fibers. For example, U.S. Pat. Nos. 7,134,267 and 7,367,176 assigned to the assignee of the present application describe rope subcomponents comprising fibers combined to provide desirable strength and surface characteristics to the rope structure.

The need exists for rope structures that optimize a given operating characteristic or set of characteristics of a rope structure while also minimizing the cost of materials used to form the rope structure.

SUMMARY

The present invention may be embodied as a rope structure comprising a plurality of rope subcomponents, a plurality of bundles, a plurality of first yarns, and a plurality of second yarns. The rope subcomponents are combined to form the rope structure. The bundles are combined to form the rope subcomponents. The first yarns are formed of at least one material selected from the group of materials comprising HMPE, LCP, Aramids, and PBO and have a breaking elongation of approximately 2%-5%. The plurality of second yarns are formed of at least one material selected from the group of materials comprising polyolefin, polyethylene, polypropylene, and blends or copolymers of the two and have a breaking elongation of approximately 2%-12%. The first and second yarns are combined to form the bundles.

The present invention may also be embodied as a method of forming a rope structure comprising the following steps. A plurality of first yarns are formed of at least one material selected from the group of materials comprising HMPE, LCP, Aramids, and PBO and have a breaking elongation of approximately 2%-5%. A plurality of second yarns are formed of at least one material selected from the group of materials comprising polyolefin, polyethylene, polypropylene, and blends or copolymers of the two and have a breaking elongation of approximately 2%-12%. The plurality of first yarns and the plurality of second yarns are combined to form a plurality of bundles. The plurality of bundles are combined to form a plurality of rope subcomponents. The plurality of rope subcomponents are combined to form the rope structure.

The present invention may also be embodied as a rope structure comprising a plurality of rope subcomponents, a plurality of bundles, a plurality of first yarns, and a plurality of second yarns. The rope subcomponents are combined to form the rope structure. The bundles are combined to form the rope subcomponents. The first yarns have a tenacity of approximately 25-45 gpd and have a breaking elongation of approximately 2%-5%. The second yarns have a tenacity of approximately 6-22 gpd and have a breaking elongation of approximately 2%-12%. The first and second yarns are combined to form the bundles.

DETAILED DESCRIPTION

The present invention relates to rope structures comprising blended fibers and methods of making rope structures comprising blended fibers. In the following discussion, a first, more general example will be described in Section I with reference to FIG. 1, and second and third more specific examples will be described in Section II-VI with reference to FIGS. 2-6, respectively. One of the example rope subcomponent forming methods is described in further detail in Section VII below.

I. First Example

Rope Structure and Method

Figure 1:
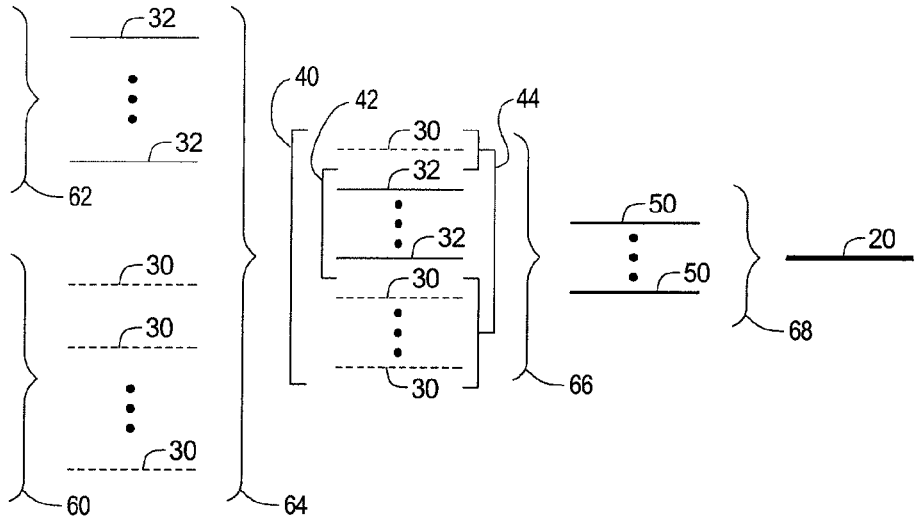
FIG. 1 is a highly schematic view depicting a first example rope system of the present invention and a method of fabricating the first example rope system.

Referring initially to FIG. 1 of the drawing, depicted therein is a first example rope structure 20 constructed in accordance with, and embodying, the principles of the present invention. The example rope structure 20 comprises a plurality of first yarns 30 and second yarns 32. The first yarns 30 and second yarns 32 are combined to form bundles 40. The example bundles 40 each comprise a center portion 42 comprising the second yarns 32. The first yarns 30 are arranged to define a cover portion 44 of the example bundles 40. The example bundles 40 are further processed to obtain a plurality of rope subcomponents 50. The rope subcomponents 50 are combined to form the rope structure 20.

In the example rope structure 20, the first yarns 30 are arranged to define the cover portion 44 of the bundles 40 and the second yarns are arranged to define the center portion 42. Alternatively, the first yarn could form the center portion and the second yarn could form the cover portion of the bundle. In yet another example, the first and second yarns could be evenly distributed throughout the bundles 40 and thus the substantially evenly throughout the rope subcomponents 50 and the rope structure 20. As still another example, the rope structure could be formed by a combination of the various forms of yarns described herein.

The example first yarns 30 are formed of a material such as High Modulus PolyEthylene (HMPE). Alternatively, the first yarns 30 may be formed by any high modulus (i.e., high tenacity with low elongation) fiber such as LCP, Aramids, and PBO. The example first yarns 30 have a tenacity of approximately 40 gpd and a breaking elongation of approximately 3.5%. The tenacity of the first yarns 30 should be within a first range of approximately 30-40 gpd and in any event should be within a second range of approximately 25-45 gpd. The breaking elongation of the first yarns 30 should be in a first range of approximately 3.0-4.0% and in any event should be within a second range of approximately 2%-5%.

The example second yarns 32 are formed of a material such as high modulus polypropylene (HMPP). As one example, the second yarns 32 may be formed of high modulus polyolefin fiber such as high modulus fibers made from resins such as polyethylene, polypropylene, blends, or copolymers of the two. Typically, such fibers are fabricated using the melt-spinning process, but the second yarns 32 may be fabricated using processes instead of or in addition to melt-spinning process. Alternative materials include any material having characteristics similar to High Modulus PolyproPylene (HMPP) or PEN. Examples of commercially available materials (identified by tradenames) that may be used to form the second yarns include Ultra Blue, Innegra, and Tsunooga.

In a first example, the fibers forming the example second yarns 32 have a tenacity of approximately 10 gpd and a breaking elongation of approximately 8%. In this first example, the tenacity of the fibers forming the second yarns 32 should be within a first range of approximately 9-12 gpd and in any event should be within a second range of approximately 7.0-20.0 gpd. The breaking elongation of the fibers forming the example second yarns 32 should be in a first range of approximately 5.0-10.0% and in any event should be within a second range of approximately 3.5%-12.0%.

In a second example, the fibers forming the example second yarns 32 have a tenacity of approximately 8.5 gpd and a breaking elongation of approximately 7%. In this second example, the tenacity of the fibers forming the first yarns 30 should be within a first range of approximately 7-12 gpd and in any event should be within a second range of approximately 6.0-22.0 gpd. The breaking elongation of the fibers forming the example second yarns 32 should be in a first range of approximately 5.0%-10.0% and in any event should be within a second range of approximately 2.0%-12.0%.

The example bundles 40 comprise approximately 35-45% by weight of the first yarns 30. The percent by weight of the example first yarns 30 should be within a first range of approximately 40-60% by weight and, in any event, should be within a second range of approximately 20-80% by weight. In any of the situations described above, the balance of the bundles 40 may be formed by the second yarns 32 or a combination of the second yarns 32 and other materials.

The example rope structure 20 comprises a plurality of the bundles 40, so the example rope structure 20 comprises the same percentages by weight of the first and second yarns 30 and 32 as the bundles 40.

The exact number of strands in the first yarns 30 and the second yarns 32 is based on the yarn size (i.e., diameter) and is pre-determined with the ratio of the first and second yarns.

Referring now for a moment back to FIG. 1 of the drawing, a first example method of manufacturing the example rope structure 20 will now be described. Initially, first and second steps represented by brackets 60 and 62 are performed. In the first step 60, the first yarns 30 are provided; in the second step 62, the second yarns 32 are provided. In a third step represented by bracket 64, the first yarns 30 and the second yarns 32 are twisted into the bundle 40 such that the second yarns 32 form the center portion 42 and the first yarns 30 form the cover portion 44 of the bundle 40.

In an optional fourth step represented by bracket 66, the bundles 40 are twisted to form the rope subcomponents 50. The example rope subcomponent 50 is thus a twisted blend fiber bundle. Alternatively, a plurality of the bundles 40 may be twisted in second, third, or more twisting steps to form a larger rope subcomponent 50 as required by the dimensions and operating conditions of the rope structure 20.

One or more of the rope subcomponents 50 are then combined in a fifth step represented by bracket 68 to form the rope structure 20. The example fifth step 68 is a braiding or twisting step, and the resulting rope structure 20 is thus a braided or twisted blend fiber rope.

Optionally, after the fifth step 68, the rope structure 20 may be coated with water based polyurethane or other chemistry or blends to provide enhanced performance under certain operating conditions. Examples of appropriate coatings include one or more materials such as polyurethane (e.g., Permuthane, Sancure, Witcobond, Eternitex, Icothane), wax (e.g., Recco, MA-series emulsions), and lubricants (e.g., E22 Silicone, XPT260, PTFE 30).

II. Second Example

Rope Structure and Method

Figure 2:
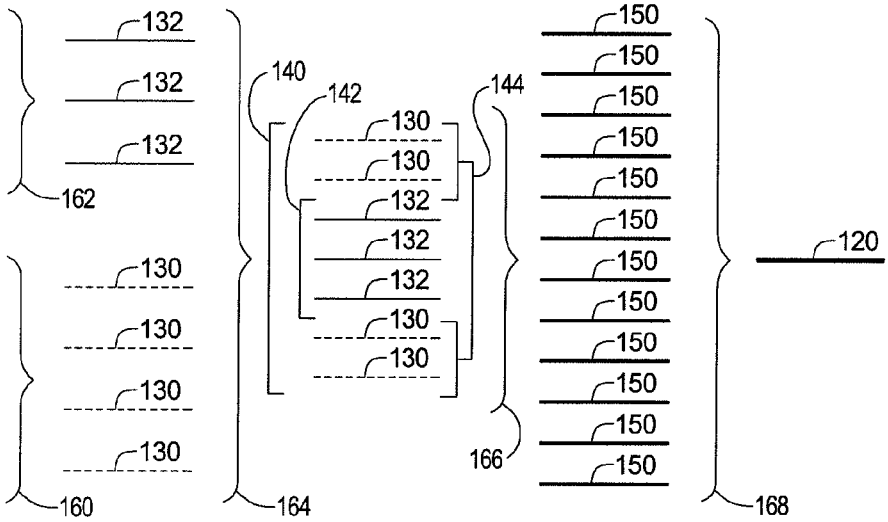
FIG. 2 is a highly schematic view depicting a second example rope system of the present invention and a method of fabricating the second example rope system.

Referring now to FIG. 2 of the drawing, depicted therein is a second example rope structure 120 constructed in accordance with, and embodying, the principles of the present invention. The example rope structure 120 comprises four first yarns 130 and three second yarns 132. The first yarns 130 and second yarns 132 are combined to form a bundle 140. The bundle 140 comprises a center portion 142 comprising the second yarns 132. The first yarns 130 are arranged to define a cover portion 144 of the bundle 140. The bundle 140 is further processed to obtain twelve rope strands 150. The twelve rope strands 150 are combined to form the rope structure 120.

The example first yarns 130 are formed of HMPE and have a size of approximately 1600 denier, a tenacity of approximately 40 gpd, a modulus of approximately 1280 gpd, and a breaking elongation of approximately 3.5%. The example second yarns 132 are formed of HMPP and have a size of approximately 2800 denier, a tenacity of approximately 8.5 or 10.0 gpd, a modulus of approximately 190 gpd or 225 gpd, and a breaking elongation of approximately 7.0% or 8.0%. The following tables A and B describe first and second ranges of fiber characteristics for the first and second yarns 130 and 132, respectively:

| A. First Yarn | | |
|---|---|---|
| Characteristic | First Range | Second Range |
| tenacity (gpd) | 30-40 | 25-45 |
| modulus (gpd) | 900-1500 | 475-3500 |
| breaking elongation (%) | 3-4 | 2-5 |

| B. Second Yarn | | |
|---|---|---|
| Characteristic | First Range | Second Range |
| tenacity (gpd) | 7-12 | 6-22 |
| modulus (gpd) | 100-300 | 50-500 |
| breaking elongation (%) | 5-10 | 2-12 |

The example rope structure 120 comprises approximately 43% of HMPE by weight and had an average breaking strength of approximately 4656 lbs. In comparison, a rope structure comprising twelve strands of HMPE fibers (100% HMPE by weight) has an average breaking strength of approximately 8600 lbs. The example rope structure 120 thus comprises less than half of HMPE fibers but has a breaking strength of more than half of that of a rope structure of pure HMPE fibers.

Additionally, the rope structure 120 has a calculated tenacity of greater than approximately 17 gpd (before accounting for strength loss due to manufacturing processes) (medium tenacity) and a specific gravity of less than 1 and thus floats in water. In the manufacturing process, there is an efficiency loss due to twisting, braiding and processing of the fibers. The more a fiber is twisted or distorted from being parallel, the higher the efficiency loss will be. In a typical rope manufacturing operation, the actual rope strength is only about 50% of the initial fiber strength when expressed as tenacity in gpd.

Accordingly, a rope structure comprising 12 strands of HMPE fiber (100% HMPE by weight) has an average breaking strength of 8600 lbs which equates to 22.5 gpd, or 56% of the original fiber tenacity of 40 gpd. The blended rope comprising 43% HMPE and 57% HMPP has a tenacity of 12.0 gpd (based on fiber tenacity and the same 56% strength efficiency). The rope structure 120 can thus be used as a floating rope having a medium level tenacity (12.0 gpd rope tenacity) and relatively low cost in comparison to a rope comprising only HMPE fibers (22.5 gpd rope tenacity).

Referring now for a moment back to FIG. 2 of the drawing, a first example method of manufacturing the example rope structure 120 will now be described. Initially, first and second steps represented by brackets 160 and 162 are performed. In the first step 160, four ends of the first yarns 130 are provided; in the second step 162, the three ends of the second yarns 132 are provided. In a third step represented by bracket 164, the first yarns 130 and the second yarns 132 are blended into the bundle 140 such that the second yarns 132 form the center portion 142 and the first yarns 130 form the cover portion 144 of the bundle 140.

In a fourth step represented by bracket 166, the bundle 140 is twisted to form the strands 150. The example rope strand 150 is thus a twisted blend fiber bundle. As discussed above, a plurality of the bundles 140 may be twisted in second, third, or more twisting steps to form a larger strand as required by the dimensions and operating conditions of the rope structure 120.

Twelve of the yarns 150 formed from the bundles 140 are then combined in a fifth step represented by bracket 168 to form the rope structure 120. The example fifth step 168 is a braiding step, and the resulting rope structure 120 is thus a ¼" diameter braided blend fiber rope. Optionally, after the fifth step, the rope structure 120 may be coated with water based polyurethane or other chemistry or blends to provide enhanced performance under certain operating conditions.

III. Third Example

Rope Structure and Method

Figure 3:
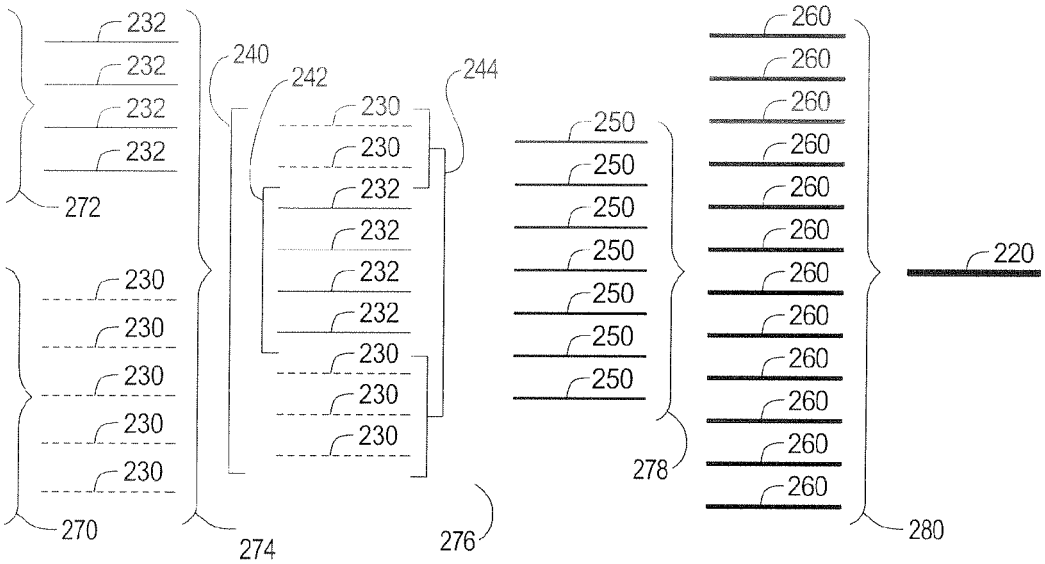
FIG. 3 is a highly schematic view depicting a third example rope system of the present invention and a method of fabricating the third example rope system.

Referring now to FIG. 3 of the drawing, depicted therein is a third example rope structure 220 constructed in accordance with, and embodying, the principles of the present invention. The example rope structure 220 comprises five first yarns 230 and four second yarns 232. The first yarns 230 and second yarns 232 are combined to form a bundle 240. The bundle 240 comprises a center portion 242 comprising the second yarns 232. The first yarns 230 are arranged to define a cover portion 244 of the bundle 240. The bundle 240 is further processed to obtain sub-strands 250. Seven of the sub-strands 250 are combined to form large strands 260. Twelve of the large strands 260 are combined to form the rope structure 220.

The example first yarns 230 are formed of HMPE and have a size of 1600 denier, a tenacity of approximately 40 gpd, a modulus of approximately 1280 gpd, and a breaking elongation of approximately 3.5%. The example second yarns 232 are formed of HMPP and have a size of approximately 2800 denier, a tenacity of approximately 8.5 gpd or 10.0 gpd, a modulus of approximately 190 gpd or 225 gpd, and a breaking elongation of approximately 7.0% or 8.0%. The following tables C and D describe first and second ranges of fiber characteristics for the first and second yarns 230 and 232, respectively:

| C. First Yarn | | |
|---|---|---|
| Characteristic | First Range | Second Range |
| tenacity (gpd) | 30-40 | 25-45 |
| modulus (gpd) | 900-1500 | 475-3500 |
| breaking elongation (%) | 3-4 | 2-5 |

| D. Second Yarn | | |
|---|---|---|
| Characteristic | First Range | Second Range |
| tenacity (gpd) | 7-12 | 6-22 |
| modulus (gpd) | 100-300 | 50-500 |
| breaking elongation (%) | 5-10 | 2-12 |

The example rope structure 220 comprises approximately 42% of HMPE by weight and had an average breaking strength of approximately 37,000 lbs. In comparison, a similar rope structure comprising HMPE fibers (100% HMPE by weight) has an average breaking strength of approximately 64,400 lbs. The example rope structure 220 thus comprises less than half of HMPE fibers but has a breaking strength of more than half of that of a rope structure of pure HMPE fibers.

Additionally, the rope structure 220 has a calculated tenacity of greater than approximately 27 gpd (before accounting for strength loss due to manufacturing processes) (medium tenacity) and a specific gravity of less than 1 and thus floats in water. In the manufacturing process, there is an efficiency loss due to twisting, braiding and processing of the fibers. In a typical rope manufacturing operation, the actual rope strength is only about 50% of the initial fiber strength when expressed as tenacity in gpd. A rope structure comprising 12 strands of HMPE fiber (100% HMPE by weight) has an average breaking strength of 64400 lbs which equates to 20.0 gpd, or 50% of the original fiber tenacity of 40 gpd. The blended rope comprising 42% HMPE and 58% HMPP has a tenacity of 10.8 gpd (based on fiber tenacity and the same 50% strength efficiency). The rope structure 220 can thus be used as a floating rope having a medium level tenacity (10.8 gpd rope tenacity) and relatively low cost in comparison to a rope comprising only HMPE fibers (20.0 gpd rope tenacity).

Referring now for a moment back to FIG. 2 of the drawing, a first example method of manufacturing the example rope structure 220 will now be described. Initially, first and second steps represented by brackets 270 and 272 are performed. In the first step 270, four ends of the first yarns 230 are provided; in the second step 272, the three ends of the second yarns 232 are provided. In a third step represented by bracket 274, the first yarns 230 and the second yarns 232 are twisted into the bundle 240 such that the second yarns 232 form the center portion 242 and the first yarns 230 form the cover portion 244 of the bundle 240.

In a fourth step represented by bracket 276, the bundles 240 are twisted to form the strands 250. The example rope strand 250 is thus a twisted blend fiber bundle. In a fifth step 278, seven of the strands 250 may be twisted together to form the larger strand 260.

Twelve of the larger strands 260 are then combined in a fifth step represented by bracket 280 to form the rope structure 220. The example fifth step 280 is a braiding step, and the resulting rope structure 220 is thus a ¾" diameter braided blend fiber rope. Optionally, after the fifth step, the rope structure 220 may be coated with water based polyurethane or other chemistry or blends to provide enhanced performance under certain operating conditions.

IV. Fourth Example

Rope Structure and Method

Figure 4:
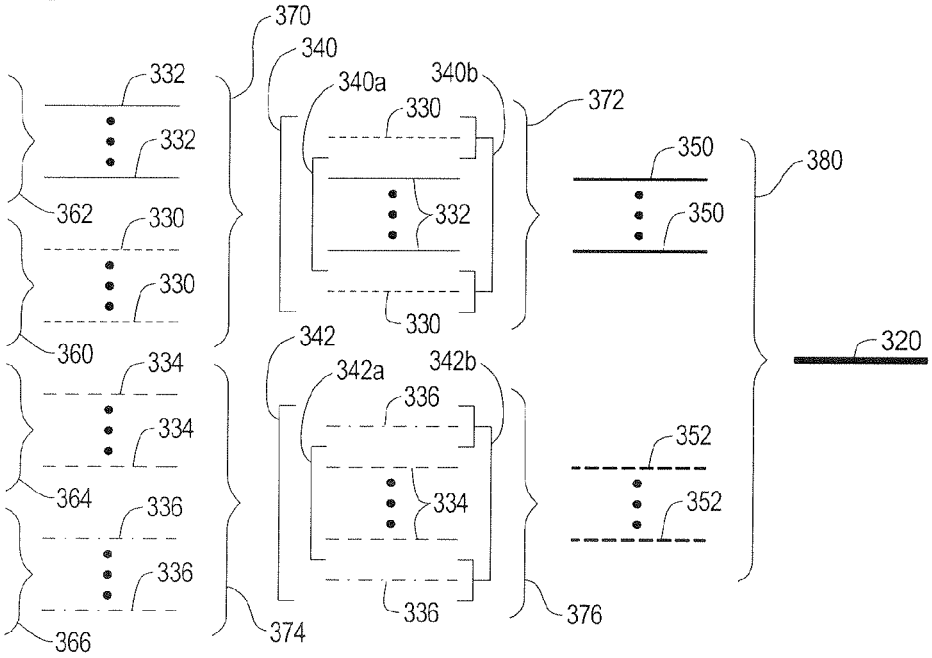
FIG. 4 is a highly schematic view depicting a fourth example rope system of the present invention and a method of fabricating the fourth example rope system.

Referring now to FIG. 4 of the drawing, depicted therein is a fourth example rope structure 320 constructed in accordance with, and embodying, the principles of the present invention. The example rope structure 320 comprises a plurality of first yarns 330, a plurality of second yarns 332, a plurality of third yarns 334, and a plurality of fourth yarns 336. The first yarns 330 and second yarns 332 are combined to form a plurality of first bundles 340. The first bundles 340 comprise a center portion 340*a* comprising the second yarns 332. The first yarns 330 are arranged to define a cover portion 340*b* of the first bundles 340. The third yarns 334 and fourth yarns 336 are combined, preferably using a false-twisting process, to form a plurality of second bundles 342. The second bundles 342 comprise a center portion 342*a* comprising the third yarns 334. The fourth yarns 336 are arranged to define a cover portion 342*b* of the second bundles 342.

The first bundles 340 are further processed to obtain sub-strands 350. The second bundles 342 are processed to obtain sub-strands 352. The first and second subcomponents or strands 350 and 352 are combined to form the rope structure 320.

The example first yarns 330 are formed of HMPE and have a size of 1600 denier, a tenacity of approximately 40 gpd, a modulus of approximately 1280 gpd, and a breaking elongation of approximately 3.5%. The example second yarns 332 are formed of HMPP and have a size of approximately 2800 denier, a tenacity of approximately 8.5 gpd, a modulus of approximately 190 gpd, and a breaking elongation of approximately 7.0%. Like the first yarns 330, the example third yarns 334 are also formed of HMPE and have a size of approximately 1600 denier, a tenacity of approximately 40.0 gpd, and a breaking elongation of approximately 3.5%. However, the first and third yarns 330 and 334 may be different. The example fourth yarns 336 are formed of Polyester sliver and have a size of approximately 52 grain. However the fourth yarn may be of one or more of the following materials: polyester, nylon, Aramid, LCP, and HMPE fibers.

The following tables E, F, G, and H describe first and second ranges of fiber characteristics for the first, second, and third yarns 330, 332, 334 respectively:

E. First Yarn

| Characteristic | First Range | Second Range |
|---|---|---|
| tenacity (gpd) | 30-40 | 25-45 |
| modulus (gpd) | 900-1500 | 475-3500 |
| breaking elongation (%) | 3-4 | 2-5 |

F. Second Yarn

| Characteristic | First Range | Second Range |
|---|---|---|
| tenacity (gpd) | 7-12 | 6-22 |
| modulus (gpd) | 100-300 | 50-500 |
| breaking elongation (%) | 5-10 | 2-12 |

G. Third Yarn

| Characteristic | First Range | Second Range |
|---|---|---|
| tenacity (gpd) | 30-40 | 25-45 |
| breaking elongation (%) | 3-4 | 2-5 |

The example rope structure 320 comprises approximately 42% of HMPE by weight and 6% Polyester Sliver by weight and had an average breaking strength of approximately 302,000 lbs. In comparison, a similar rope structure comprising HMPE fibers (94% HMPE by weight) and Polyester Sliver (6% Polyester by weight) has an average breaking strength of approximately 550,000 lbs. The example rope structure 320 thus comprises less than half of HMPE fibers but has a breaking strength of more than half of that of a rope structure of HMPE and Polyester sliver fibers.

Additionally, the rope structure 320 has a specific gravity of less than 1 and thus floats in water. The rope structure 320 can thus be used as a floating rope having a medium level of strength and tenacity and relatively low cost in comparison to a rope comprising only HMPE fibers.

Referring now for a moment back to FIG. 4 of the drawing, a first example method of manufacturing the example rope structure 320 will now be described. Initially, the first, second, third, and fourth yarns 330, 332, 334, and 336 are provided at steps 360, 362, 364, and 366.

In a step represented by bracket 370, the first yarns 330 and the second yarns 332 are twisted into the bundles 340 such that the second yarns 332 form a center portion 340*a* and the first yarns 330 form a cover portion 340*b* of the bundle 340. In a step represented by bracket 372, the bundles 340 are twisted to form the strands 350. The example rope strands 350 are thus twisted blend fiber bundles.

In a step represented by bracket 374, the third yarns 334 and the fourth yarns 336 are false twisted into the bundles 342 such that the third yarns 334 form a center portion 342*a* and the fourth yarns 336 form a cover portion 342*b* of the bundle 342. In step represented by bracket 376, the bundles 342 are false-twisted together to form the strands 352. The example rope strand 352 is thus a false-twisted blend fiber bundle.

At a final step represented by bracket 380, the first and second strands 350 and 352 are combined by any appropriate method such as twisting or braiding to form the rope structure 320. As an additional optional step, the rope structure 320 may be coated as generally described above.

V. Fifth Example

Rope Structure and Method

Figure 5:
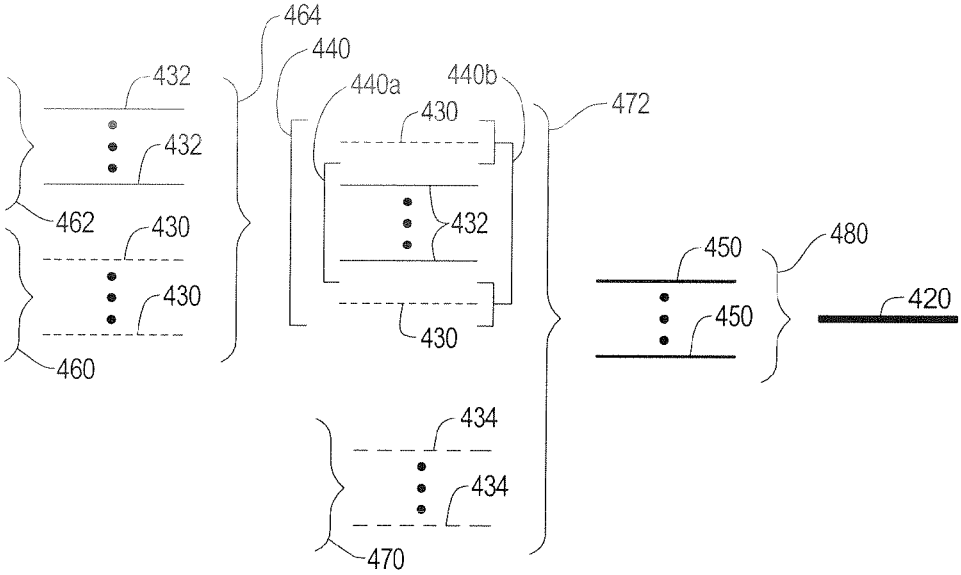
FIG. 5 is a highly schematic view depicting a fifth example rope system of the present invention and a method of fabricating the fifth example rope system.

Referring now to FIG. 5 of the drawing, depicted therein is a fifth example rope structure 420 constructed in accordance with, and embodying, the principles of the present invention. The example rope structure 420 comprises a plurality of first yarns 430, a plurality of second yarns 432, and a plurality of third yarns 434. The first yarns 430 and second yarns 432 are combined to form a plurality of first bundles 440. The first bundles 440 comprise a center portion 440*a* comprising the second yarns 432. The first yarns 430 are arranged to define a cover portion 440*b* of the first bundles 440.

The third yarns 434 are combined, preferably using a false-twisting process, with the first bundles 440 to form rope subcomponents or strands 450. The first and second yarns 430 and 432 are arranged to define a core portion of the strands 450. The third yarns 434 are arranged to define at least a portion of the cover portion of the strands 450.

The example first yarns 430 are formed of HMPE and have a size of 1600 denier, a tenacity of approximately 40 gpd, a modulus of approximately 1280 gpd, and a breaking elongation of approximately 3.5%. The example second yarns 432 are formed of HMPP and have a size of approximately 2800 denier, a tenacity of approximately 8.5 gpd, a modulus of approximately 190 gpd, and a breaking elongation of approximately 7.0%. The example third yarns 434 are formed of Polyester sliver and have a size of approximately 52 grain.

The following tables H and I describe first and second ranges of fiber characteristics for the first and second, yarns 430 and 432, respectively:

H. First Yarn

| Characteristic | First Range | Second Range |
|---|---|---|
| tenacity (gpd) | 30-40 | 25-45 |
| modulus (gpd) | 900-1500 | 475-3500 |
| breaking elongation (%) | 3-4 | 2-5 |

I. Second Yarn

| Characteristic | First Range | Second Range |
|---|---|---|
| tenacity (gpd) | 7-12 | 6-22 |
| modulus (gpd) | 100-300 | 50-500 |
| breaking elongation (%) | 5-10 | 2-12 |

The example rope structure 420 comprises less than half of HMPE fibers but has a breaking strength of more than half of that of a rope structure of pure HMPE fibers.

Additionally, the rope structure 420 has a specific gravity of less than 1 and thus floats in water. The rope structure 420 can thus be used as a floating rope having a medium level of strength and tenacity and relatively low cost in comparison to a rope comprising only HMPE fibers.

Referring now for a moment back to FIG. 5 of the drawing, a first example method of manufacturing the example rope structure 420 will now be described. Initially, at a step 460, the first yarns 430 are provided; at a step 462, the second yarns 432 are provided. In a step represented by bracket 464, the first yarns 430 and the second yarns 432 are combined into the bundles 440 such that the second yarns 432 form the center portion 440*a* and the first yarns 430 form the cover portion 440*b* of the bundle 440.

In a step 470, the third yarns 434 are provided. In a step represented by bracket 472, the third yarns 434 are false twisted with the bundles 440 to form the strands 450 such that the third yarns 434 form the cover portion of the bundle 450. At a final step represented by bracket 480, the strands 450 are combined by any appropriate method, such as twisting or braiding, to form the rope structure 420.

As an additional optional step, the rope structure 420 may be coated as generally described above.

VI. Sixth Example

Rope Structure and Method

Figure 6:
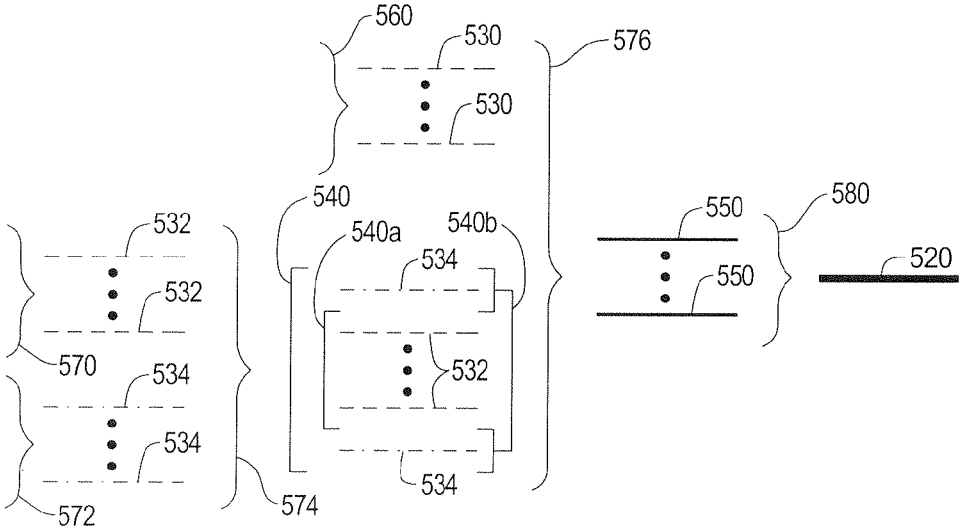
FIG. 6 is a highly schematic view depicting a sixth example rope system of the present invention and a method of fabricating the sixth example rope system.

Referring now to FIG. 6 of the drawing, depicted therein is a sixth example rope structure 520 constructed in accordance with, and embodying, the principles of the present invention. The example rope structure 520 comprises a plurality of first yarns 530 arranged in bundles, a plurality of second yarns 532, and a plurality of third yarns 534. The second yarns 532 and third yarns 534 are combined, preferably using a false-twisting process, to form a plurality of second bundles 540. The second bundles 540 comprise a center portion 540*a* comprising the second yarns 532. The third yarns 534 are arranged to define a cover portion 540*b* of the second bundles 540.

The bundles of first yarns 530 are combined with the second bundles 540 to form rope subcomponents or strands 550. The second and third yarns 532 and 534 are arranged to define a core portion of the strands 550. The bundles of first yarns 530 are arranged to define at least a portion of a cover portion of the strands 550.

The example first yarns 530 are formed of HMPE and have a size of 1600 denier, a tenacity of approximately 40 gpd, a modulus of approximately 1280 gpd, and a breaking elongation of approximately 3.5%. The example second yarns 532 are formed of HMPP and have a size of approximately 2800 denier, a tenacity of approximately 8.5 gpd, a modulus of approximately 190 gpd, and a breaking elongation of approximately 7.0%. The example third yarns 534 are formed of Polyester sliver and have a size of approximately 52 grain.

The following tables J and K describe first and second ranges of fiber characteristics for the first and second yarns 530 and 532 respectively:

| J. First Yarn | | |
|---|---|---|
| Characteristic | First Range | Second Range |
| tenacity (gpd) | 30-40 | 25-45 |
| modulus (gpd) | 900-1500 | 475-3500 |
| breaking elongation (%) | 3-4 | 2-5 |

| K. Second Yarn | | |
|---|---|---|
| Characteristic | First Range | Second Range |
| tenacity (gpd) | 7-12 | 6-22 |
| modulus (gpd) | 100-300 | 50-500 |
| breaking elongation (%) | 5-10 | 2-12 |

The example rope structure 520 comprises less than half of HMPE fibers but has a breaking strength of more than half of that of a rope structure of pure HMPE fibers. Additionally, the rope structure 520 has a specific gravity of less than 1 and thus floats in water. The rope structure 520 can thus be used as a floating rope having a medium level of strength and tenacity and relatively low cost in comparison to a rope comprising only HMPE fibers.

Referring now for a moment back to FIG. 5 of the drawing, a first example method of manufacturing the example rope structure 520 will now be described. Initially, at a step 560, the first yarns 530 are provided, typically in the form of bundles. At steps 570 and 572, the second yarns 532 and third yarns 534 are provided. In a step represented by bracket 574, the second yarns 532 and the third yarns 534 are combined, preferably using a false-twisting process, into the bundles 540 such that the second yarns 532 form the center portion 540*a* and the third yarns 534 form the cover portion 540*b* of the bundle 540.

In a step represented by bracket 576, the first yarns 530 (or bundles formed therefrom) are twisted with the bundles 540 to form the strands 550. At a final step represented by bracket 580, the strands 550 are combined by any appropriate method, such as twisting or braiding, to form the rope structure 520.

As an additional optional step, the rope structure 520 may be coated as generally described above.

VII. False Twisting Process

As described above, a bundle of first fibers (e.g., yarns) may be combined with a bundle of second fibers (e.g., yarns) using a false twisting process to form rope subcomponents which are in turn combined to form other rope subcomponents and/or rope structures. The false twisting process is described, for example, in U.S. Pat. Nos. 7,134,267 and 7,367,176, the specifications of which are incorporated herein by reference.

What is claimed is:

1. A rope structure comprising:

a plurality of rope subcomponents, where the rope subcomponents are combined to form the rope structure;

a plurality of bundles, where the bundles are combined to form the rope subcomponents;

a plurality of first yarns, where the first yarns are formed of at least one material selected from the group of materials comprising HMPE, LCP, Aramids, and PBO, have a breaking elongation of approximately 2%-5%, and have a tenacity of approximately 25-45 gpd; and a plurality of second yarns, where the second yarns are formed of at least one material selected from the group of materials comprising polyolefin, polyethylene, polypropylene, and blends or copolymers of the two, have a breaking elongation of approximately 2%-12%, and have a tenacity of approximately 6-22 gpd; wherein the first and second yarns are combined to form the bundles;

the bundles comprise approximately 20-80% by weight of the first yarns.

2. A rope structure as recited in claim 1, in which the bundles comprise approximately 20-80% by weight of the second yarns.

3. A rope structure as recited in claim 2, in which the bundles comprise approximately 20-80% by weight of the second yarns and other materials.

4. A method of forming a rope structure comprising the steps of:

providing a plurality of first yarns, where the first yarns are formed of at least one material selected from the group of materials comprising HMPE, LCP, Aramids, and PBO, have a breaking elongation of approximately 2%-5%, and the first yarns have a tenacity of approximately 25-45 gpd;

providing a plurality of second yarns, where the second yarns are formed of at least one material selected from the group of materials comprising polyolefin, polyethylene, polypropylene, and blends or copolymers of the two, have a breaking elongation of approximately 2%-12%, and have a tenacity of approximately 6-22 gpd;

combining the plurality of first yarns and the plurality of second yarns to form a plurality of bundles, where the bundles comprise approximately 40-60% by weight of the first yarns;

combining the plurality of bundles to form a plurality of rope subcomponents; and combining the plurality of rope subcomponents to form the rope structure.

5. A rope structure as recited in claim 4, in which the bundles comprise approximately 35-45% by weight of the first yarns.

6. A method as recited in claim 4, in which the step of combining the plurality of first yarns and the plurality of second yarns to form a plurality of bundles comprises the step of forming the bundles such that the bundles comprise approximately 35-45% by weight of the first yarns.

7. A rope structure comprising:

a plurality of rope subcomponents, where the rope subcomponents are combined to form the rope structure;

a plurality of bundles, where the bundles are combined to form the rope subcomponents;

a plurality of first yarns, where the first yarns have a tenacity of approximately 25-45 gpd, and have a breaking elongation of approximately 2%-5%; and a plurality of second yarns, where the second yarns have a tenacity of approximately 6-22 gpd, and have a breaking elongation of approximately 2%-12%; wherein the first and second yarns are combined to form the bundles.

8. A rope structure as recited in claim 7, in which the bundles comprise approximately 20-80% by weight of the first yarns.

9. A rope structure as recited in claim 8, in which the bundles comprise approximately 20-80% by weight of the second yarns.

10. A rope structure as recited in claim 9, in which the bundles comprise approximately 20-80% by weight of the second yarns and other materials.

11. A rope structure as recited in claim 8, in which:

the first yarns are formed of at least one material selected from the group of materials comprising HMPE, LCP, Aramids, and PBO; and the second yarns are formed of at least one material selected from the group of materials comprising polyolefin, polyethylene, polypropylene, and blends or copolymers of the two.

12. A rope structure as recited in claim 10, in which:

the first yarns are formed of at least one material selected from the group of materials comprising HMPE, LCP, Aramids, and PBO; and the second yarns are formed of at least one material selected from the group of materials comprising polyolefin, polyethylene, polypropylene, and blends or copolymers of the two.

13. A rope structure comprising:

a plurality of rope subcomponents, where the rope subcomponents are combined to form the rope structure;

a plurality of bundles, where the bundles are combined to form the rope subcomponents;

a plurality of first yarns, where the first yarns are formed of at least one material selected from the group of materials comprising HMPE, LCP, Aramids, and PBO, have a breaking elongation of approximately 2%-5%, and have a tenacity of approximately 25-45 gpd; and a plurality of second yarns, where the second yarns are formed of at least one material selected from the group of materials comprising polyolefin, polyethylene, polypropylene, and blends or copolymers of the two, have a breaking elongation of approximately 2%-12%, and have a tenacity of approximately 6-22 gpd; wherein the first and second yarns are combined to form the bundles; and the bundles comprise approximately 20-80% by weight of the second yarns.

14. A rope structure as recited in claim 13, in which the bundles comprise approximately 20-80% by weight of the first yarns.

15. A rope structure as recited in claim 13, in which the bundles comprise approximately 20-80% by weight of the second yarns and other materials.

16. A method of forming a rope structure comprising the steps of:

providing a plurality of first yarns, where the first yarns are formed of at least one material selected from the group of materials comprising HMPE, LCP, Aramids, and PBO, have a breaking elongation of approximately 2%-5%, and have a tenacity of approximately 25-45 gpd;

providing a plurality of second yarns, where the second yarns are formed of at least one material selected from the group of materials comprising polyolefin, polyethylene, polypropylene, and blends or copolymers of the two, have a breaking elongation of approximately 2%-12%, and have a tenacity of approximately 6-22 gpd;

combining the plurality of first yarns and the plurality of second yarns to form a plurality of bundles such that the bundles comprise approximately 40-60% by weight of the first yarns;

combining the plurality of bundles to form a plurality of rope subcomponents; and combining the plurality of rope subcomponents to form the rope structure.

17. A rope structure as recited in claim 16, in which the bundles comprise approximately 35-45% by weight of the first yarns.

18. A method as recited in claim 16, in which the step of combining the plurality of first yarns and the plurality of second yarns to form a plurality of bundles comprises the step of forming the bundles such that the bundles comprise approximately 35-45% by weight of the first yarns.

19. A method as recited in claim 16, in which:

the step of providing the first yarns comprises the step of providing the first yarns such that the first yarns have a tenacity of approximately 25-45 gpd; and the step of providing the second yarns comprises the step of providing the second yarns such that the second yarns have a tenacity of approximately 6-22 gpd.

* * * * *